US011305967B2

(12) United States Patent
Okuda et al.

(10) Patent No.: US 11,305,967 B2
(45) Date of Patent: Apr. 19, 2022

(54) ELEVATOR RENEWAL CONSTRUCTION METHOD AND ELEVATOR CONTROL PANEL

(71) Applicant: Mitsubishi Electric Corporation, Tokyo (JP)

(72) Inventors: Seiji Okuda, Tokyo (JP); Chikashi Yoshimura, Tokyo (JP); Mugihei Tanaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 394 days.

(21) Appl. No.: 16/469,146

(22) PCT Filed: Dec. 16, 2016

(86) PCT No.: PCT/JP2016/087666
§ 371 (c)(1),
(2) Date: Jun. 13, 2019

(87) PCT Pub. No.: WO2018/109946
PCT Pub. Date: Jun. 21, 2018

(65) Prior Publication Data

US 2020/0095096 A1 Mar. 26, 2020

(51) Int. Cl.
*B66B 19/00* (2006.01)
*B66B 1/34* (2006.01)
*B66B 1/46* (2006.01)

(52) U.S. Cl.
CPC ..... *B66B 19/007* (2013.01); *B66B 1/3446* (2013.01); *B66B 1/46* (2013.01); *B66B 19/005* (2013.01)

(58) Field of Classification Search
CPC ..... B66B 19/007; B66B 1/3446; B66B 1/46; B66B 19/005
(Continued)

(56) References Cited

U.S. PATENT DOCUMENTS 4,844,204 A * 7/1989 Ovaska ..... B66B 1/18 187/247
5,352,857 A * 10/1994 Ovaska ..... B66B 1/18 187/247
(Continued)

FOREIGN PATENT DOCUMENTS

DE 692 10 123 B1 9/1996
JP 9278313 A 10/1997
(Continued)

OTHER PUBLICATIONS

Extended European Search Report dated Nov. 28, 2019 in European Application No. 16924202.1-1017.
(Continued)

*Primary Examiner* — Jeffrey Donels
(74) *Attorney, Agent, or Firm* — Xsensus LLP

(57) ABSTRACT

An elevator renewal construction method includes a series of divided construction work steps, each being determined as such a unit that the elevator operation becomes normally possible after finishing of each of the divided construction work steps, wherein one of the series of the divided construction work steps comprises the steps of: replacing an old control panel of the existing elevator with a new control panel; connecting an old cable for an old car device, which has connected the old car device and the old control panel of the existing elevator to each other, to a communication conversion unit provided in the new control panel; and converting a new serial communication system to an old serial communication system by the new control panel via the communication conversion unit and the old cable to control the old car device through the old serial communication system.

16 Claims, 8 Drawing Sheets

| DIVIDED CONSTRUCTION WORK STEP | DETAILS OF RENEWAL | MAIN DEVICE TO BE REPLACED |
|---|---|---|
| STEP 1 | IMPROVEMENT OF MACHINE ROOM | CONTROL PANEL AND SO ON |
| STEP 2 | IMPROVEMENT OF CAR | ON-CAR STATION, DOOR DRIVING DEVICE, CAR OPERATING PANEL, TRAVELING CABLE, AND SO ON |
| STEP 3 | IMPROVEMENT OF HOISTWAY AND HALL | HALL OPERATING PANEL, TERMINAL SLOWDOWN SWITCH, HOISTWAY CABLE, AND SO ON |
| STEP 4 | REPLACEMENT OF TRACTION MACHINE | TRACTION MACHINE, MAIN ROPE, WEIGHING DEVICE, AND SO ON |
| STEP 5 | WORK FOR EARTHQUAKE SAFETY | S-WAVE SEISMIC SENSOR AND SO ON |

(58) Field of Classification Search
USPC ..... 187/380
See application file for complete search history.

(56) References Cited

U.S. PATENT DOCUMENTS

| | | | | |
|---|---|---|---|---|
| 5,389,748 | A * | 2/1995 | Burke | B66B 1/18 187/247 |
| 6,892,861 | B2 * | 5/2005 | Friedli | B66B 1/18 187/247 |
| 6,935,465 | B2 * | 8/2005 | Friedli | B66B 1/18 187/247 |
| 8,967,335 | B2 * | 3/2015 | Friedli | B66B 1/2458 187/247 |
| 2005/0224297 | A1 * | 10/2005 | Felder | B66B 1/462 187/395 |
| 2008/0264731 | A1 * | 10/2008 | Mangini | B66B 1/463 187/382 |
| 2012/0023722 | A1 | 2/2012 | Endo | |
| 2015/0274488 | A1 * | 10/2015 | Ramakrishnan | B66B 1/18 187/387 |
| 2020/0095096 | A1 * | 3/2020 | Okuda | B66B 1/46 |

FOREIGN PATENT DOCUMENTS

| | | | |
|---|---|---|---|
| JP | 200381556 | A | 3/2003 |
| JP | 2006206196 | A | 8/2006 |
| JP | 2009-220998 | A | 10/2009 |
| JP | 4806155 | B2 | 8/2011 |
| JP | 2013155013 | A | 8/2013 |
| JP | 5733843 | B2 | 4/2015 |
| JP | 5750034 | B2 | 5/2015 |
| JP | 5851263 | B2 | 12/2015 |
| WO | 2011001495 | A1 | 1/2011 |

OTHER PUBLICATIONS

Korean Office Action dated Jan. 29, 2021 in Korean Application No. 10-2019-7016786.

Indian Office Action dated Jun. 23, 2021 in Indian Application No. 201947023470.

International Search Report and Written Opinion dated Mar. 7, 2017, International Application No. PCT/JP2016/087666, (with English translation), 16 pages.

* cited by examiner

| DIVIDED CONSTRUCTION WORK STEP | DETAILS OF RENEWAL | MAIN DEVICE TO BE REPLACED |
|---|---|---|
| STEP 1 | IMPROVEMENT OF MACHINE ROOM | CONTROL PANEL AND SO ON |
| STEP 2 | IMPROVEMENT OF CAR | ON-CAR STATION, DOOR DRIVING DEVICE, CAR OPERATING PANEL, TRAVELING CABLE, AND SO ON |
| STEP 3 | IMPROVEMENT OF HOISTWAY AND HALL | HALL OPERATING PANEL, TERMINAL SLOWDOWN SWITCH, HOISTWAY CABLE, AND SO ON |
| STEP 4 | REPLACEMENT OF TRACTION MACHINE | TRACTION MACHINE, MAIN ROPE, WEIGHING DEVICE, AND SO ON |
| STEP 5 | WORK FOR EARTHQUAKE SAFETY | S-WAVE SEISMIC SENSOR AND SO ON |

FIG. 2

ELEVATOR RENEWAL CONSTRUCTION METHOD AND ELEVATOR CONTROL PANEL

CROSS-REFERENCE TO RELATED APPLICATIONS

The present application is based on PCT filing PCT/JP2016/087666, filed Dec. 16, 2016, the entire contents of which are incorporated herein by reference.

TECHNICAL FIELD

The present invention relates to an elevator renewal construction method for replacing an existing elevator with a new elevator and to an elevator control panel to be used for renewal of an elevator.

BACKGROUND ART

In order to cope with aging degradation of a device or to improve performance such as energy saving performance, elevator renewal for replacing an existing elevator with a new elevator is performed. During an elevator renewal construction period, an operation of the elevator is required to be continuously suspended for a long period of time.

Thus, for example, especially in a condominium or a hospital with a large number of elderly people, a long elevator out-of-service period has been a major obstacle to the renewal. Accordingly, in the renewal of the elevator, a continuous elevator out-of-service period is required to be shortened as much as possible in view of convenience of a user.

In order to shorten the continuous elevator out-of-service period, there is proposed an elevator controller including a new transmission control unit and a new/old transmission conversion unit. The new transmission control unit uses a new serial transmission system different from an old serial transmission system at least in data transmission speed. The new/old transmission conversion unit includes a new transmission control CPU, an old transmission control CPU, and a dual-port memory. The new transmission control CPU is connected to the new transmission control unit. The old transmission control CPU is connected to an old transmission control unit of the old serial transmission system, which is provided on a hall side. The dual-port memory is connected to both of the new transmission control CPU and the old transmission control CPU. The dual-port memory stores data of the old serial transmission system, which is transmitted from an old transmission conversion unit provided on the hall side, via the old transmission control CPU and retains the thus stored data so that the stored data is accessible from the new transmission control unit via the new transmission control CPU. Meanwhile, the dual-port memory stores data of the new serial transmission system, which is transmitted from the new transmission control unit, via the new transmission control CPU and retains the thus stored data so that the stored data is accessible from the old transmission control unit provided on the hall side via the old transmission control CPU (see, for example, Patent Literature 1).

CITATION LIST

Patent Literature

[PTL 1] JP 5851263 B2

SUMMARY OF INVENTION

Technical Problem

In the elevator renewal construction method using the elevator controller, which is described in Patent Literature 1, however, time required for renewal of an elevator control panel is shortened with continuous use of components used in an existing elevator without replacement thereof. Thus, there is a problem in that the above-mentioned elevator renewal construction method does not contribute to the shortening of the continuous elevator out-of-service period in the elevator renewal for replacing the existing elevator with the new elevator.

Further, in the elevator controller described in Patent Literature 1, the elevator control panel is required to include the new transmission control CPU, the old transmission control CPU, and the dual-port memory so that the elevator controller converts transmission signals to be transmitted in the different transmission systems and retains the converted transmission signals. Hence, there are problems in that a configuration becomes complex and that cost increases.

The present invention has been made to solve the problems described above, and has an object to provide an elevator renewal construction method, with which a continuous elevator out-of-service period in an elevator renewal construction period can be shortened, and an elevator control panel having a simple configuration, with which cost can be reduced.

Solution to Problem

The elevator renewal construction method according to one embodiment of the present invention, for renewing at least one device in an existing elevator, includes the steps of: dividing a process of renewal construction work into a series of divided construction work steps, each being determined as such a unit that the elevator operation becomes normally possible after finishing of each of the divided construction work steps; and executing the renewal construction work in accordance with the series of divided construction work steps, in which one of the series of the divided construction work steps includes the steps of: replacing an old control panel of the existing elevator with a new control panel; connecting an old cable for an old car device, which has connected the old car device and the old control panel of the existing elevator to each other, to a communication conversion unit, which is provided in the new control panel, and is configured to mutually convert a communication method between an old communication system for the old control panel and a new communication system for the new control panel, which has a higher communication speed than a communication speed of the old communication system to enable transmission and reception of a larger capacity of data; and converting a new serial communication system to an old serial communication system by the new control panel via the communication conversion unit and the old cable to control the old car device through the old serial communication system.

The elevator control panel according to one embodiment of the present invention includes an elevator control unit configured to control a car device and a hall device of an elevator through the new communication system having the higher communication speed than the communication speed of the old communication system to enable the transmission and the reception of the larger capacity of data, and the communication conversion unit, which is connected to the elevator control unit, and is configured to mutually convert the communication system between the old communication system and the new communication system, in which the communication conversion unit includes one CPU and one memory and is provided so as to be removable from the elevator control panel.

Advantageous Effects of Invention

The elevator renewal construction method according to one embodiment of the present invention includes the steps of: dividing a process of renewal construction work into a series of divided construction work steps, each being determined as such a unit that the elevator operation becomes normally possible after finishing of each of the divided construction work steps; and executing the renewal construction work in accordance with the series of divided construction work steps, in which one of the series of the divided construction work steps includes the steps of: replacing an old control panel of the existing elevator with a new control panel; connecting an old cable for an old car device, which has connected the old car device and the old control panel of the existing elevator to each other, to a communication conversion unit, which is provided in the new control panel, and is configured to mutually convert a communication method between an old communication system for the old control panel and a new communication system for the new control panel, which has a higher communication speed than a communication speed of the old communication system to enable transmission and reception of a larger capacity of data; and converting a new serial communication system to an old serial communication system by the new control panel via the communication conversion unit and the old cable to control the old car device through the old serial communication system.

Moreover, the elevator control panel according to one embodiment of the present invention includes an elevator control unit configured to control a car device and a hall device of an elevator through the new communication system having the higher communication speed than the communication speed of the old communication system to enable the transmission and the reception of the larger capacity of data, and the communication conversion unit, which is connected to the elevator control unit, and is configured to mutually convert the communication system between the old communication system and the new communication system, in which the communication conversion unit includes one CPU and one memory and is provided so as to be removable from the elevator control panel.

Thus, the elevator renewal construction method, with which the elevator can be used even during the elevator renewal construction period so that the continuous elevator out-of-service period in the elevator renewal construction period is shortened, and the elevator control panel having the simple configuration, with which the cost can be reduced, can be obtained.

BRIEF DESCRIPTION OF DRAWINGS

FIG. 2 is an explanatory table for showing details of renewal and main devices to be replaced in divided construction work steps in the elevator renewal construction method according to the first embodiment of the present invention.

DESCRIPTION OF EMBODIMENTS

A description is now given of an elevator renewal construction method and an elevator control panel to be used for renewal of an elevator according to preferred embodiments of the present invention referring to the accompanying drawings, and throughout the drawings, like or corresponding components are denoted by like reference symbols to describe those components. The elevator control panel is hereinafter simply referred to also as "control panel".

First Embodiment

Figure 1:
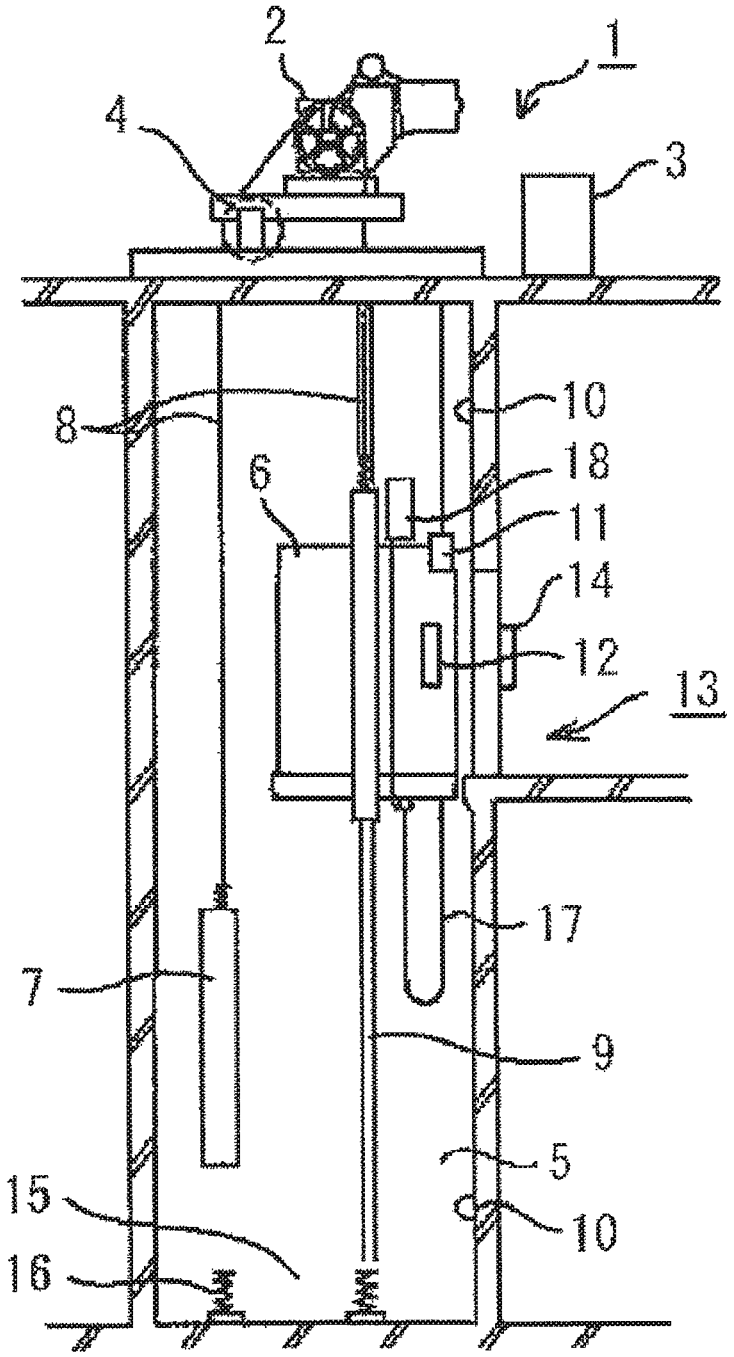
FIG. 1 is a configuration view for illustrating an elevator device to which an elevator renewal construction method according to a first embodiment of the present invention is to be applied.

FIG. 1 is a configuration view for illustrating an elevator device to which an elevator renewal construction method according to a first embodiment of the present invention is to be applied. In FIG. 1, in a machine room 1, there are provided a hoisting machine 2 including a hoisting motor, a control panel 3, and a speed governor 4. In a hoistway 5, there are provided a car 6, a counterweight 7, a main rope 8, guide rails 9, and a terminal slowdown switch 10. The main rope 8 is configured to connect the car 6 and the counterweight 7. A door driving device 11, which includes a door motor, and a car operating panel 12 are provided to the car 6. A hall operating panel 14 is provided at a hall 13. Buffers 16 are provided in a pit 15. The control panel 3 and an on-car station 18 are connected to each other through a traveling cable 17. The on-car station 18 and a car device are connected to each other. The on-car station 18 has a door opening/closing control function and a relaying function with another car device.

In this case, the "car device" denotes a device provided to and around the car, such as the door driving device 11, the car operating panel 12, and the on-car station 18. The "hall device" denotes a device provided at and around the hall, such as the hall operating panel 14. A "hoistway device"

denotes, for example, the terminal slowdown switch 10 and a hoistway cable not shown in FIG. 1.

In the first embodiment of the present invention, in order to shorten a continuous elevator out-of-service period in an elevator renewal construction period, renewal construction work is divided into a plurality of divided construction work steps. At the same time, there is developed the elevator control panel capable of controlling, for example, both of a new hoisting machine and an old hoisting machine so that the elevator is available after completion of each of the divided construction work steps.

Specifically, the shortening of the continuous elevator out-of-service period in the elevator renewal construction period presupposes the availability of the elevator at the time of completion of each of the divided construction work steps of the renewal construction work. For example, in a condominium, the elevator is required to be available in morning and night hours in which a large number of users use the elevator for, for example, commuting to and from work and school. In a restaurant tenant building, the elevator is required to be available in evening and night business hours.

Thus, work time that can be ensured for one day is set. Based on a result of analysis of details of work and time required for each part of work, the details of work, which can be completed within the time, are set for each of the divided construction work steps. The details of renewal and main devices to be replaced in the divided construction work steps are shown in FIG. 2. In FIG. 2, the renewal construction work is divided mainly into five divided construction work steps. However, the divided construction work steps are required to be organized into groups depending on specifications of the elevator.

More specifically, after a series of the divided construction work steps of replacing old devices with new devices are organized into groups, between which an elevator available time period is set, the renewal construction work is carried out. Further, the elevator available time period is determined in accordance with a frequency of activation of the elevator before the renewal and a purpose of use of a building. Further, the renewal construction work is carried out after the divided construction work steps are organized into the divided construction work step groups, each of which is completed in the least work time ensured for one day and after which the elevator is available. Specifically, a normal operation mode and an installation work mode are set. Each time the divided construction work step is completed, the installation work mode is switched to the normal operation mode to bring the elevator into a service available state so as to perform a normal operation for providing elevator service to a passenger.

Renewal Construction Method

Figure 3:
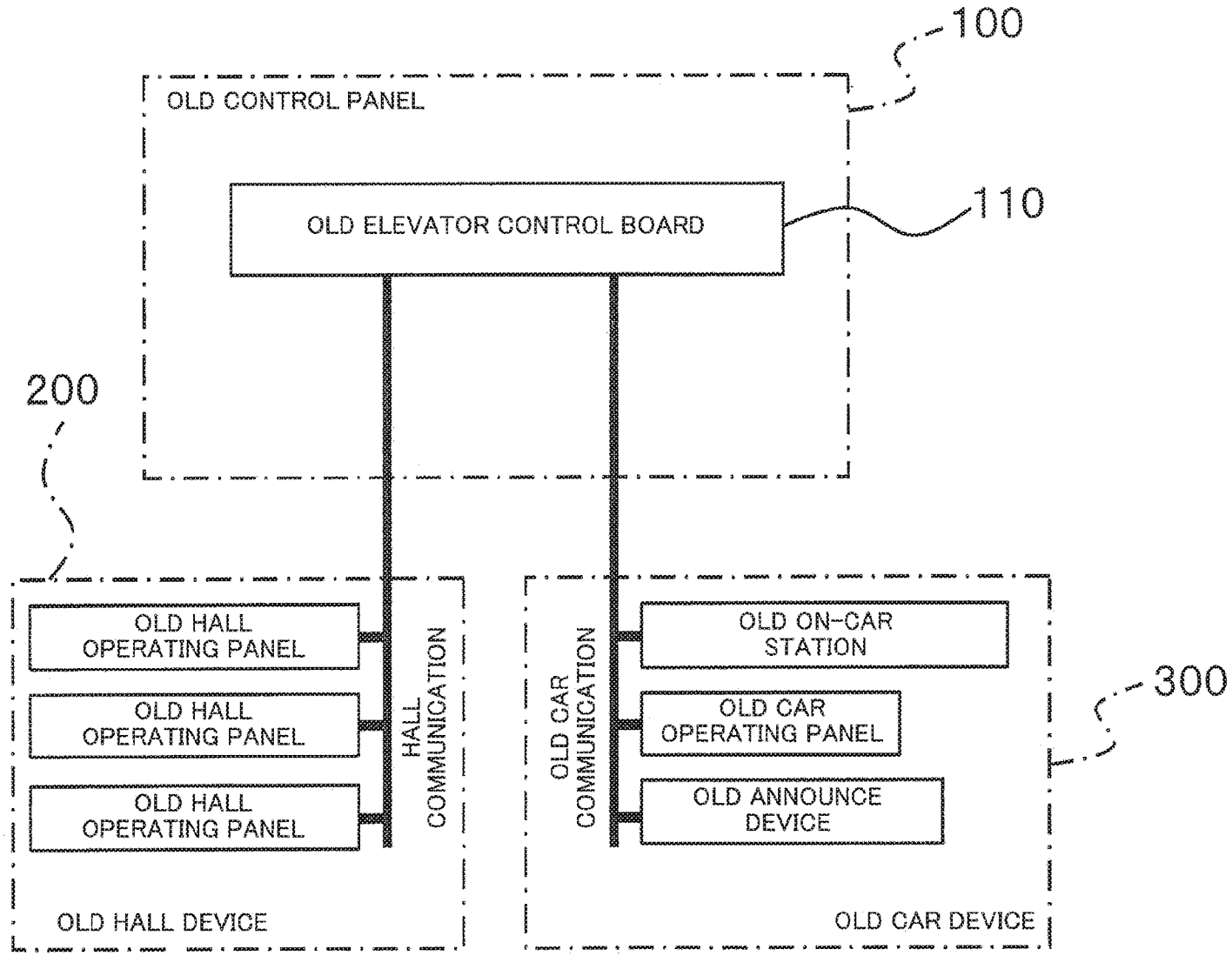
FIG. 3 is a block configuration diagram for illustrating an initial state in the elevator device to which the elevator renewal construction method according to the first embodiment of the present invention is to be applied.

Subsequently, with reference to FIG. 3 to FIG. 8 together with FIG. 1 and FIG. 2, an elevator renewal construction method according to the first embodiment of the present invention is described. FIG. 3 is a block configuration diagram for illustrating an initial state in the elevator device to which the elevator renewal construction method according to the first embodiment of the present invention is to be applied.

In FIG. 3, when the elevator device is in the initial state, an old hall device 200 and an old hall device 300 are connected to an old control panel 100 before replacement, through an old serial communication system. The old control panel 100 includes an old elevator control board 110 configured to control, for example, operations of the old hall device 200, the old car device 300, and the old hoisting machine (not shown).

Divided Construction Work Step 1: Machine Room Improvement

Figure 4:
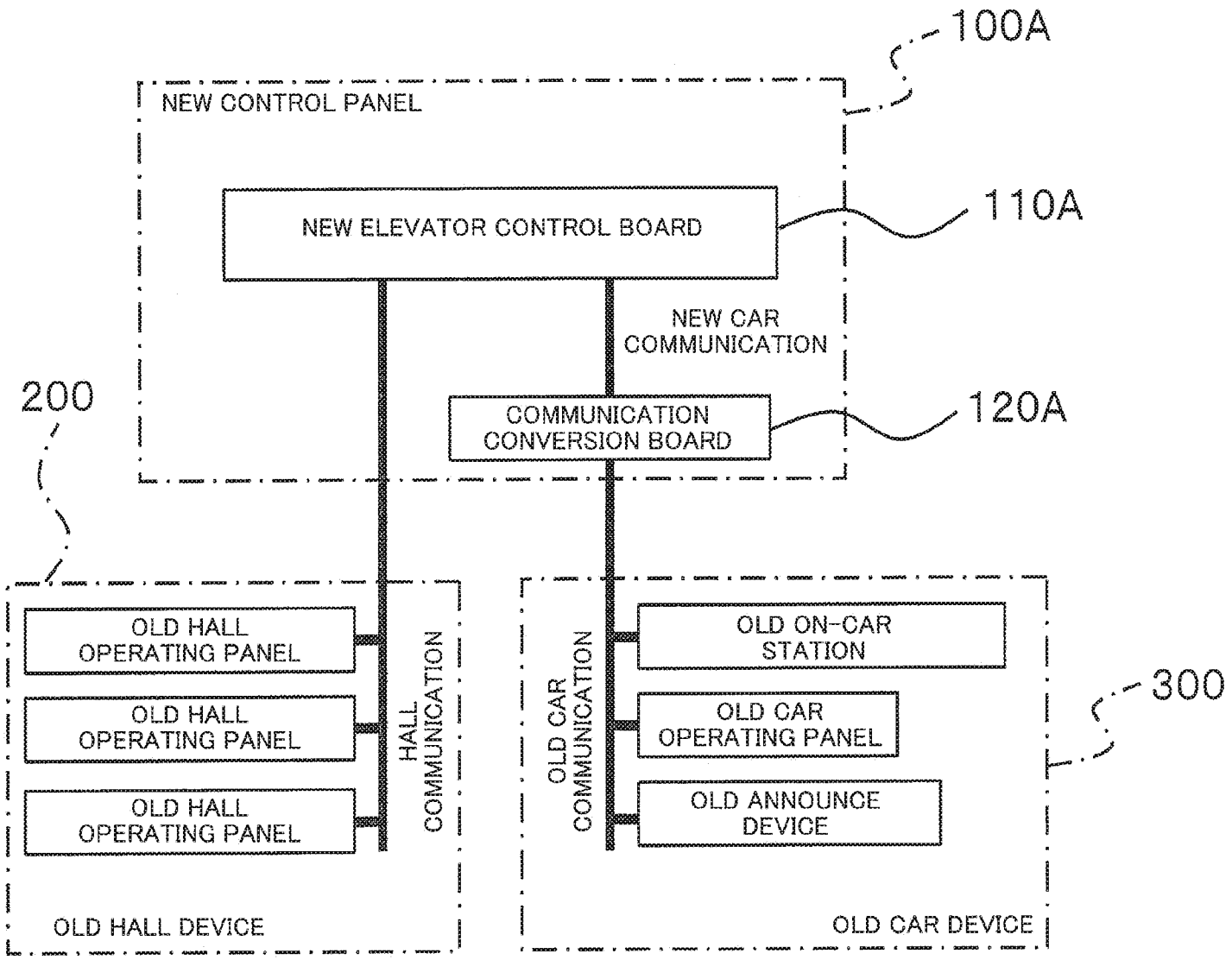
FIG. 4 is a block configuration diagram for illustrating a state after replacement of a control panel in the elevator device to which the elevator renewal construction method according to the first embodiment of the present invention is applied.

For the elevator device, in a divided construction work step 1 shown in FIG. 2, the elevator control panel is replaced. FIG. 4 is a block configuration diagram for illustrating a state after the replacement of the control panel in the elevator device to which the elevator renewal construction method according to the first embodiment of the present invention is applied.

The reason why the elevator control panel is first replaced in the divided construction work step 1 is as follows. When the hall device or the car device is first replaced, exchange of information with the replaced device increases. Thus, it becomes difficult to deal with the exchange of the information with the existing elevator control panel to give rise to the need of modification. Thus, when the hall device or the car device is replaced after the elevator control panel is first replaced in the divided construction work step 1, a new elevator control panel, which is provided after the replacement, can deal with the exchange of the information with a new hall device or a new car device.

In FIG. 4, as a result of the replacement of the old control panel 100 with a new control panel 100A, the old hall device 200 and the old car device 300 are connected to the new control panel 100A. The new control panel 100A includes a new elevator control board 110A in place of the old elevator control board 110 illustrated in FIG. 3.

The new elevator control board 110A has not only a function of controlling operations of, for example, a new hall device, a new car device, and a new hoisting machine, which are described later, but also a function of controlling operations of the old hall device 200, the old car device 300, and the old hoisting machine with change of setting of parameters in accordance with each of the divided construction work steps shown in FIG. 2.

However, the new elevator control board 110A communicates with the car device through a new serial communication system, for example, a controller area network (CAN) communication system, which enables transmission and reception of a larger capacity of data than that through an old serial communication system. Thus, the new elevator control board 110A and the old car device 300 cannot directly communicate with each other. As an example of the old serial communication system, a communication speed of 4,800 bps is given. As an example of the CAN communication system, a communication speed of 122.88 kbps is given. Thus, a data transmission speed of the new serial communication system is about 10 times or higher than a data transmission speed of the old serial communication system.

Further, a larger capacity of data can be transmitted and received through communication through the CAN communication system than through the old serial communication system. Thus, a display device mounted in the new car device has the effect of displaying a larger capacity of data than on a display device mounted in the old car device. A new function, which is not provided to the old car device, for example, a touch-type car operating function integral with the display device, can be achieved in the new car device.

The data to be transmitted and received through the communication between the new elevator control board 110A and the old car device 300 includes, for example, state information of the door driving device 11, a display command for the car operating panel 12, operation information of, for example, a button or a switch of the car operating panel 12, and an announce command.

Figure 5:
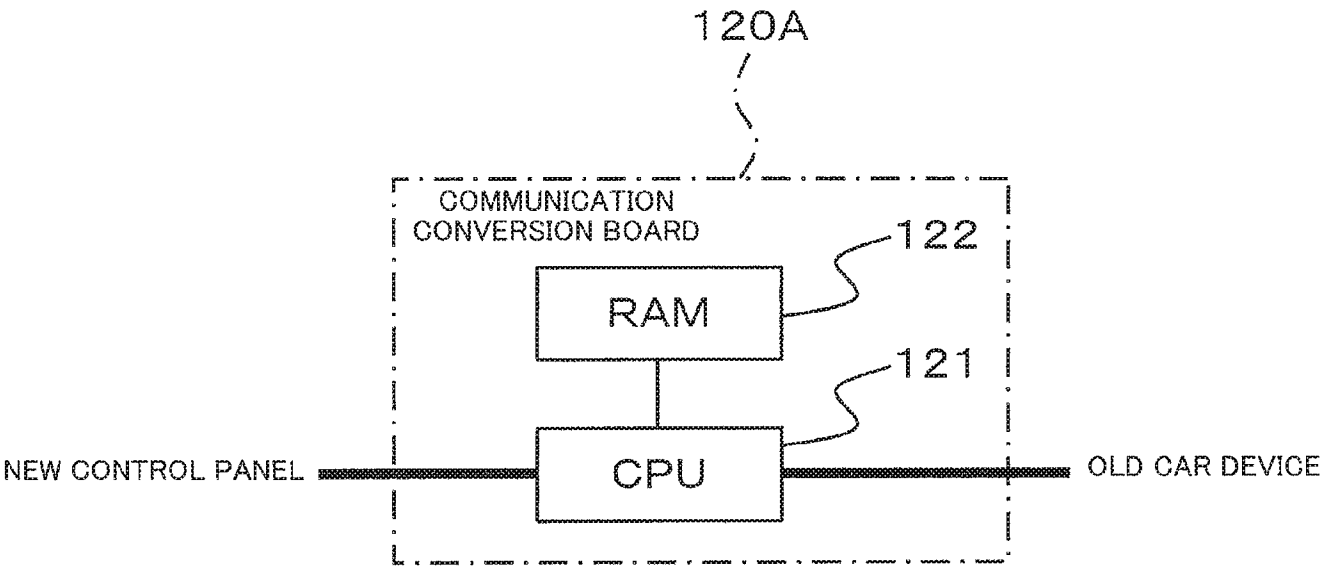
FIG. 5 is a hardware configuration diagram for illustrating a communication conversion board in the elevator control panel according to the first embodiment of the present invention.

Thus, the new control panel 100A further includes a communication conversion board 120A serving as a communication conversion unit configured to mutually convert the communication system between the old serial communication system and the CAN communication system. FIG. 5 is a hardware configuration diagram for illustrating the communication conversion board in the elevator control panel according to the first embodiment of the present invention. In FIG. 5, the communication conversion board 120A includes a CPU 121 and a RAM 122.

The CPU 121 is configured to convert a format of data transmitted from the new elevator control board 110A to a format of data compatible with the old car device 300 and store the data in the RAM 122. Further, the CPU 121 is configured to convert a format of data transmitted from the old car device 300 to a format of data compatible with the new elevator control board 110A and store the data in the RAM 122. The format refers to a data structure such as the number of bits.

Further, the CPU 121 is configured to extract and output the format-converted data from the RAM 122 in accordance with a request from the new elevator control board 110A. The CPU 121 is also configured to extract and output the format-converted data from the RAM 122 in accordance with a request from the old car device 300. As a result, the new elevator control board 110A and the old car device 300 can communicate with each other via the communication conversion board 120A.

With use of the communication conversion board 120A, even when, for example, a transmission cycle is not changed, the communication speed increases. Therefore, a data amount transmittable per cycle increases. Further, with the increase in data amount, an error check function can be enhanced.

The communication conversion board 120A is provided so as to be removable from the new control panel 100A. Specifically, after the replacement of a hall device and a car device described later, the above-mentioned devices and the new elevator control board 110A can directly communicate with each other without using the communication conversion board 120A. Thus, the communication conversion board 120A is not required after the replacement.

Accordingly, through the removal of the communication conversion board 120A from the new control panel 100A, the communication conversion board 120A can be reused at another place. Thus, cost can be reduced. The communication conversion board may be provided between the new elevator control board 110A and the old hall device 200 as needed.

In the above-mentioned manner, after the step of replacing the old control panel of an existing elevator with the new control panel, the new control panel 100A controls the old car device 300 via the communication conversion unit (communication conversion board 120A). As a result, the normal operation for providing the elevator service to the passenger can be performed. Thus, the passenger can use the elevator between the steps of the renewal construction work. Accordingly, the continuous elevator out-of-service period in the elevator renewal construction period can be shortened.

Figure 6:
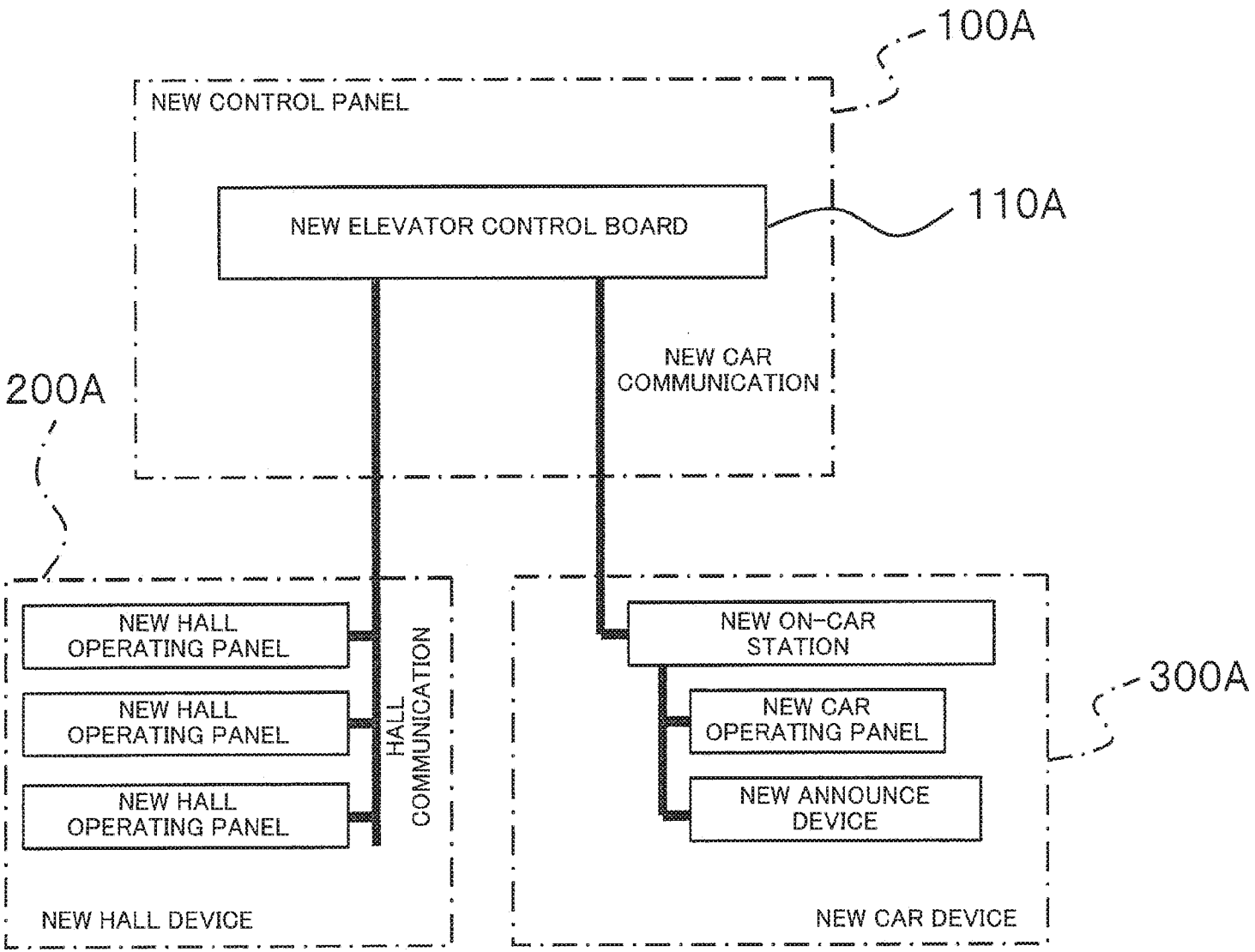
FIG. 6 is a block configuration diagram for illustrating a state after replacement of a hall device and a car device in the elevator device to which the elevator renewal construction method according to the first embodiment of the present invention is applied.

Divided Construction Work Step 2: Car Improvement and Divided Construction Work Step 3: Hoistway and Hall Improvement Next, for the elevator device, the car device is replaced in a divided construction work step 2 shown in FIG. 2, and the hall device and the hoistway device are replaced in the divided construction work step 3 shown in FIG. 2. In the divided construction work step 3, only representative hall devices are described. Any of the divided construction work step 2 and the divided construction work step 3 may be first carried out. FIG. 6 is a block configuration diagram for illustrating a state after the replacement of the hall device and the car device in the elevator device to which the elevator renewal construction method according to the first embodiment of the present invention is applied.

In FIG. 6, the old hall device 200 is replaced by a new hall device 200A, and the old car device 300 is replaced by a new car device 300A. As a result, the new hall device 200A and the new car device 300A are connected to the new control panel 100A.

In the divided construction work step 1, a cable for old devices to be connected to the new control panel 100A is continuously used in accordance with continuous use of the old hall device 200 and the old car device 300. However, a kind of a connector for a cable for the old hall device 200 and the old car device 300 and a circuit thereof are different from those of a connector for the new control panel 100A. Hence, the connectors cannot be directly connected to each other.

Figure 7:
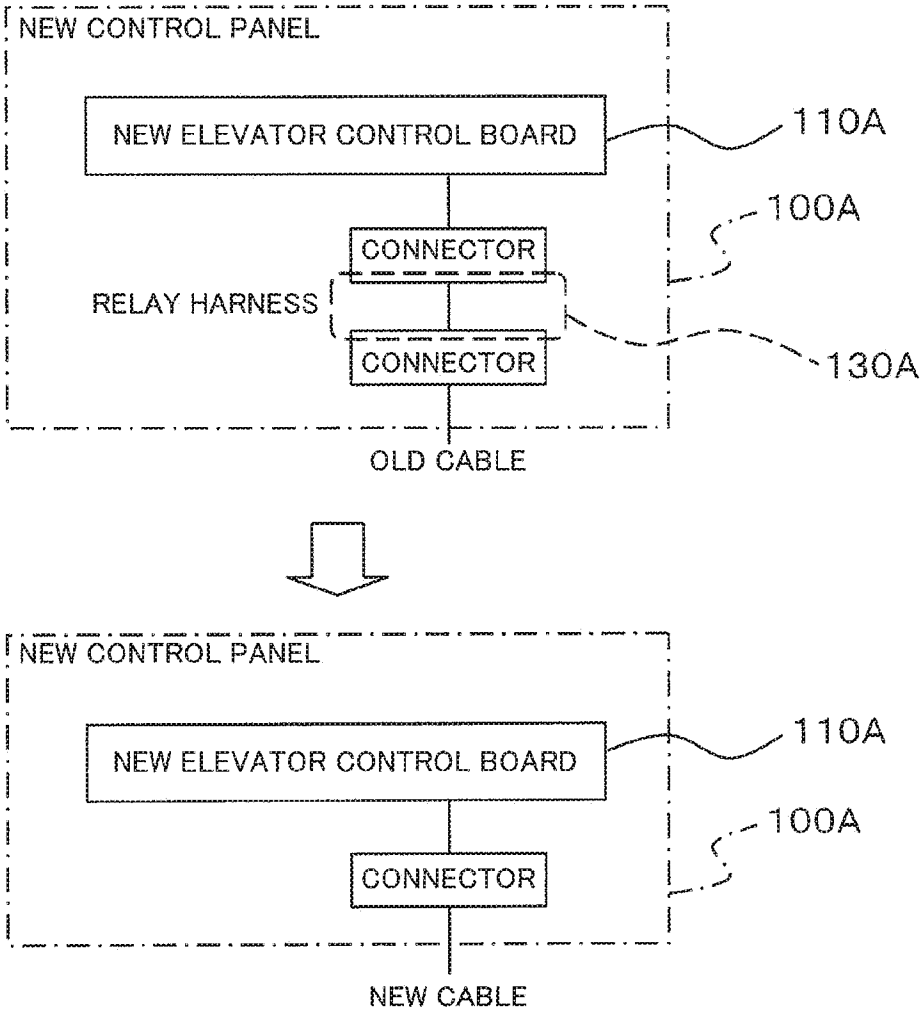
FIG. 7 is an explanatory diagram for illustrating a connection relationship of a cable in the elevator device to which the elevator renewal construction method according to the first embodiment of the present invention is applied.

Thus, as illustrated in FIG. 7, a relay harness 130A is connected to the new control panel 100A. FIG. 7 is an explanatory diagram for illustrating a connection relationship of a cable in the elevator device to which the elevator renewal construction method according to the first embodiment of the present invention is applied.

In FIG. 7, in the divided construction work step 1, an old cable is connected to the relay harness 130A. After that, when the hall device and the car device are replaced in the divided construction work step 2 and the divided construction work step 3, the old cable and the relay harness 130A are removed so that a new cable is connected to the new control panel 100A.

Hence, with the relay harness 130A, the cable for old devices can be connected to the new control panel 100A. Accordingly, the renewal with the continuous use of the cable for old devices can be achieved. The relay harness 130A may be formed integrally with the communication conversion board 120A.

Divided Construction Work Step 4: Replacement of Hoisting Machine and Divided Construction Work Step 5: Work for Earthquake Safety Subsequently, for the elevator device described above, the hoisting machine is replaced in a divided construction work step 4 shown in FIG. 2. Work for earthquake safety is carried out as a divided construction work step 5 as needed to thereby complete the renewal of the elevator.

The representative renewal construction method from the divided construction work step 1 to the divided construction work step 5 has been described above. Besides, a power failure emergency automatic hall device, which may be affected by a difference in power supply specifications of the elevator in the divided construction work step 1, is described.

The power failure emergency automatic hall device is a device configured to move a car to the nearest floor with a battery power supply to rescue a passenger in case of power failure. When a power failure is detected by the power failure emergency automatic hall device, power is supplied from an old battery device panel to the old control panel and a car control circuit in an old on-car station in an old elevator device and power is supplied from a battery in the new control panel to the new elevator control board and a car control circuit in a new on-car station in a new elevator device.

Accordingly, also in the divided construction work step 1, the car control circuit of the old on-car station is continuously used. Thus, the power is required to be supplied from the battery in the new control panel. However, power supply specifications are different due to a difference between the new control panel and the old control panel. Thus, the power cannot be supplied from the battery in the new control panel to the car control circuit in the old on-car station. Further, when the battery, which has the power supply specifications compatible with the car control circuit in the old on-car station, is used in the new control panel, the power supply cannot be supplied after the car control circuit in the old on-car station is replaced by the car control circuit in the new on-car station in the divided construction work step 2.

Figure 8:
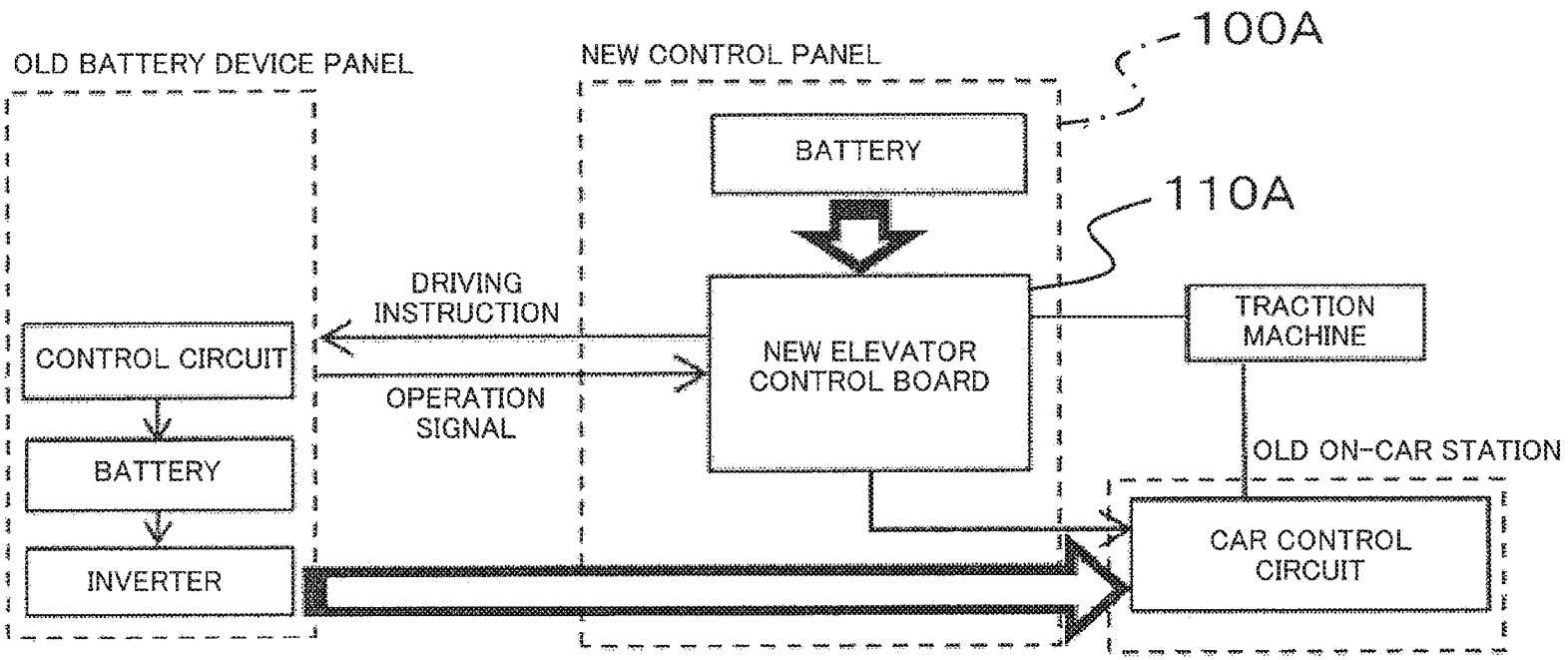
FIG. 8 is an explanatory diagram for illustrating a relationship between a new elevator device to which the elevator renewal construction method according to the first embodiment of the present invention is applied and an old battery device panel.

Thus, only for the power for the car control circuit in the old on-car station, a system configured to supply the power from the old battery device is constructed. FIG. 8 is an explanatory diagram for illustrating a relationship between the new elevator device and the old battery device panel to which the elevator renewal construction method according to the first embodiment of the present invention is applied.

In FIG. 8, when the power failure is detected, the new elevator control board 110A of the new control panel 100A outputs a driving instruction (power failure emergency automatic landing instruction) to a control circuit of the old battery device panel. When the driving instruction is input to the control circuit of the old battery, the power is supplied from a battery in the old battery device panel via an inverter to the car control circuit in the old on-car station and outputs an operation signal (power failure emergency automatic landing operation signal) to the new elevator control board 110A.

In this manner, an operation of the new control panel 100A and an operation of the old battery device panel are synchronized with each other. When the operation signal is not input from the control circuit in the old battery device panel although the new elevator control board 110A outputs the driving instruction, it is determined that an abnormality has occurred.

After the old on-car station is replaced with the new on-car station in the divided construction work step 2, the old battery device panel is not required and is therefore removed.

As described above, according to the first embodiment, the elevator renewal construction method includes the steps of: dividing the renewal construction work into the plurality of divided construction work steps; executing corresponding part of the renewal construction work in each of the plurality of execution steps; and normally operating the elevator between the plurality of divided construction work steps.

According to the first embodiment, the elevator renewal construction method includes the steps of: replacing the old control panel of the existing elevator with the new control panel; connecting the old cable for the old car device, which has connected the old car device and the old control panel of the existing elevator to each other, to the communication conversion unit of the new control panel; controlling the old car device by the new control panel via the communication conversion unit and the old cable through the serial communication system; replacing the old car device with the new car device; replacing the old cable with the new cable and connecting the new control panel and the new car device to each other through the new cable; and controlling the new car device by the new control panel through the large-capacity communication system having a larger transmission capacity than that through the serial communication system.

Further, according to the first embodiment, the elevator control panel includes the elevator control unit configured to control the car device and the hall device of the elevator through the large-capacity communication system having a larger transmission capacity than that through the serial communication system and the communication conversion unit, which is connected to the elevator control unit, and is configured to mutually convert the communication system between the serial communication system and the large-capacity communication system. The communication conversion unit includes one CPU and one memory, and is provided so as to be removable from the elevator control panel.

Thus, the elevator renewal construction method, with which the elevator can be used even during the elevator renewal construction period so that the continuous elevator out-of-service period in the elevator renewal construction period is shortened, and the elevator control panel having the simple configuration, with which the cost can be reduced, can be obtained.

Further, in order to shorten the continuous elevator out-of-service period in the elevator renewal construction period, the renewal construction work is divided into the plurality of divided construction work steps. As a result, a working area for each of the divided construction work steps can be limited to a specific area. Thus, workability can be improved.

The communication conversion unit is configured so as to be removable from the elevator control panel. As a result, the communication conversion unit can be removed from the elevator control panel so as to be reused at another place. Thus, the cost can be reduced.

In the embodiment described above, the communication conversion unit to be used in the step of replacing the old car device with the new car device has been described. However, the communication conversion unit may be applied, for example, when the old hall device is replaced by the new hall device or when an old optional device is replaced by a new optional device.

In the embodiment described above, the serial communication has been exemplified as each of the old communication system and the new communication system. However, the communication system is not limited to the serial communication. The present invention is applicable to a communication system other than the serial communication.

REFERENCE SIGNS LIST

1 machine room, 2 hoisting machine, 3 control panel, 4 speed governor, 5 hoistway, 6 car, 7 counterweight, 8 main rope, 9 guide rail, 10 terminal slowdown switch, 11 door driving device, 12 car operating panel, 13 hall, 14 hall operating panel, 16 buffer, 17 traveling cable, 18 on-car station, 100 old control panel, 100A new control panel, 110 old elevator control board, 110A new elevator control board (elevator control unit), 120A communication conversion board (communication conversion unit), 130A relay harness, 200 old hall device, 200A new hall device, 300 old car device, 300A new car device, 121 CPU, 122 RAM

The invention claimed is:

1. An elevator renewal construction method, in which, when renewing at least one device in an existing elevator, a process of renewal construction work is divided into a series of divided construction work steps, each being determined as such a unit that the elevator operation becomes normally possible after finishing of each of the divided construction work steps, and the renewal construction works are executed in accordance with the series of divided construction work steps, the series of the divided construction work steps including a first divided construction work step, the first divided construction work step comprising the steps of:

replacing an old control panel of the existing elevator with a new control panel;

providing a communication conversion unit having a function of converting a new communication system, which is adopted by the new control panel, to an old communication system, which is adopted by the old control panel; and bringing the elevator into a normally operable state after termination of the first divided construction work step in a renewal construction period by connecting an old device to the communication conversion unit and bringing the new control panel adopting the new communication system into a state of being capable of controlling the old device through the old communication system having been converted through the communication conversion unit.

2. The elevator renewal construction method according to claim 1, wherein the series of divided construction work steps are determined so that each of the divided construction work steps is completed in corresponding one of a series of construction periods, each being ensured without interruption for each renewal work day in a renewal construction period.

3. The elevator renewal construction method according to claim 1, wherein, in the step of providing the communication conversion unit in the first divided construction work step, the communication conversion unit is provided in the new control panel.

4. The elevator renewal construction method according to claim 1, wherein, in the step of bringing the elevator into a normally operable state in the first divided construction work step, the old device is connected to the communication conversion unit by connecting another end of an old cable having one end connected to the old device to the communication conversion unit, and the elevator is brought into a normally operable state through continuous use of the old cable after termination of the first divided construction work step in the renewal construction period.

5. The elevator renewal construction method according to claim 4, wherein the series of the divided construction work steps further includes a second divided construction work step subsequent to the first divided construction work step, the second divided construction work step comprising the steps of:

replacing the old device with a new device;

replacing the old cable with a new cable and connecting the new control panel and the new device through the new cable without using the communication conversion unit, and bringing the new control panel into a state so that the new device is controllable through a new communication system different from the old communication system at least in data transmission speed.

6. The elevator renewal construction method according to claim 5, wherein, in the step of bringing the elevator into a normally operable state in the first divided construction work step, the old device is connected to the communication conversion unit by connecting the another end of the old cable to connecting the communication conversion unit with using a relay harness, and wherein, in the step of connecting the new control panel and the new device through the new cable in the second divided construction work step, the new cable is directly connected to the new control panel without using the relay harness.

7. The elevator renewal construction method according to claim 5, wherein the old device comprises an old car device, and the new device comprises a new car device, wherein the series of the divided construction work steps further includes a third divided construction work step subsequent to the second divided construction work step, the third divided construction work step comprising the steps of:

replacing an old hall device and an old hoistway device connected to the old control panel with a new hall device and a new hoistway device after replacing the old control panel of the existing elevator with the new control panel; and replacing an old traction machine connected to the old control panel with a new traction machine after replacing the old car device, the old hail device, and the old hoistway device with the new car device, the new hall device, and the new hoistway device, respectively.

8. The elevator renewal construction method according to claim 5, wherein the old device and the new device comprise an old hall device and an old hoistway device, and a new hall device and a new hoistway device, respectively, wherein the third divided construction work step subsequent to the second divided construction work step comprises the steps of:

replacing an old car device connected to the old control panel with a new car device after replacing the old control panel of the existing elevator with the new control panel; and replacing an old traction machine connected to the old control panel with a new traction machine after replacing the old car device, the old hall device, and the old hoistway device with the new car device, the new hall device, and the new hoistway device, respectively.

9. The elevator renewal construction method according to claim 1, wherein the old communication system and the new communication system each comprise a serial communication system.

10. An elevator control panel, comprising:

an elevator control unit configured to control a new device of an elevator using a new communication system different from an old communication system at least in data transmission speed; and a communication conversion unit, which is connected to the elevator control unit, and is configured to mutually convert a communication system between the old communication system and the new communication system, wherein the elevator control unit is configured to be capable of controlling an old device of an elevator through the old communication system having been converted through the communication conversion unit; and wherein the communication conversion unit is provided so as to be removable from the elevator control panel.

11. The elevator control panel according to claim 10, wherein the communication conversion unit is formed integrally with a relay harness having a connector compatible with the old cable, which is to be connected to an old cable for an old device of an existing elevator.

12. The elevator control panel according to claim 10, wherein the old communication system and the new communication system each comprise a serial communication system.

13. An elevator renewal construction method for renewing at least one device in an existing elevator, comprising the steps of:

replacing an old control panel of the existing elevator with a new control panel;

converting a communication system from a new communication system to an old communication system through a communication conversion unit so as to control an old device through the old communication system;

replacing the old device with a new device; and controlling the new device by the new control panel without using the communication conversion unit through the new communication system.

14. An elevator renewal construction method for renewing at least one device in an existing elevator, comprising the steps of:

replacing an old control panel of the existing elevator with a new control panel;

connecting an old device, for connecting the old device and the old control panel of the existing elevator to each other, to a communication conversion unit;

converting a communication system from a new communication system to an old communication system by the new control panel via the communication conversion unit, to thereby control the old device through the old communication system;

replacing the old device with a new device;

connecting the new control panel and the new device to each other; and controlling the new device by the new control panel through the new communication system.

15. The elevator renewal construction method according to claim 13, wherein, in the step of controlling the old device, the new control panel controls the old device via the communication conversion unit, to thereby perform a normal operation for providing elevator service to a passenger.

16. The elevator renewal construction method according to claim 13, wherein the old communication system and the new communication system each comprise a serial communication system.

* * * * *